United States Patent [19]

Asanuma

[11] Patent Number: 4,891,675

[45] Date of Patent: Jan. 2, 1990

[54] DEVELOPER DENSITY DETECTION DEVICE

[75] Inventor: Masato Asanuma, Yamatokoriyama, Japan

[73] Assignee: Sharp Kabushiki Kaisha, Osaka, Japan

[21] Appl. No.: 240,400

[22] Filed: Aug. 29, 1988

Related U.S. Application Data

[63] Continuation of Ser. No. 129,949, Dec. 3, 1987, abandoned, which is a continuation of Ser. No. 819,629, Jan. 17, 1986, abandoned.

[30] Foreign Application Priority Data

Feb. 4, 1985 [JP] Japan ..... 60-20292

[51] Int. Cl.[4] ..... G03G 15/09

[52] U.S. Cl. ..... 355/246; 118/689

[58] Field of Search ..... 355/3 DD, 14 D, 246; 118/688–691

[56] References Cited

U.S. PATENT DOCUMENTS 3,892,672 7/1975 Gawron ..... 355/3 DD Y 4,364,659 12/1982 Noda ..... 355/14 D 4,592,645 6/1986 Kanai et al. ..... 355/14 D

FOREIGN PATENT DOCUMENTS 60-467 1/1985 Japan ..... 355/14 D

*Primary Examiner*—Arthur T. Grimley

*Assistant Examiner*—J. Pendegrass

*Attorney, Agent, or Firm*—Flehr, Hohbach, Test, Albritton & Herbert

[57] ABSTRACT

A device for detecting the density of a two-component developer consisting essentially of a toner and a carrier for an electrophotographic copying machine and the like comprises a cylindrical magnet and a sleeve which covers it. They rotate inside a developing tank so that the developer will flow in a layer on the sleeve surface. A baffle plate is provided to control this flow and to form a small pool of the developer where its density can be effectively measured by a sensor. The bottom end of the baffle plate near the sleeve surface is immersed in the developer inside the tank so that the motion of the developer into and out of the pool formed in the vicinity of the sensor is smooth and stable.

12 Claims, 2 Drawing Sheets

DEVELOPER DENSITY DETECTION DEVICE

This is a continuation of application Ser. No. 129,949 filed Dec. 3, 1987, abandoned, which is a continuation of Ser. No. 819,629, filed Jan. 17, 1986, abandoned.

This invention relates to a device adapted to be used in an electrophotographic copying machine or a laser beam printer for obtaining a visible image from an electrostatic latent image formed on a recording medium. More particularly, it relates to an improved device for detecting the toner density in a two-component developer consisting of a toner and a carrier (hereinafter referred to simply as developer density).

With a development device using a two-component developer consisting essentially of a toner and a carrier, it is impossible to stabilize the image density unless the ratio between the toner and the carrier in the developer is correctly maintained. For this reason, a sensor is usually disposed inside the development device in order to keep this ratio at a correct level at all times and to control the time to supply additional toner into the development device as well as the amount of toner to be supplied according to the output from such a sensor. As a sensor, use is frequently made, for example, of a device which measures the magnetic permeability of the developer. With a sensor of this type, the user learns from a drop in the magnetic permeability that the ratio of the toner with respect to the carrier has become large and likewise from a rise in the magnetic permeability that the ratio of the toner with respect to the carrier has become small. Reference being made to FIG. 4 which illustrates the structure of a conventional development device using a sensor of this type, a cylindrical magnet 2, a sleeve 3 serving to surroundingly cover the periphery of this magnet 2 and a stirrer roller 4 are disposed inside a development tank 1. A liquid developer 5 consisting essentially of a toner and a carrier is stirred by the stirrer roller 4 and transported upwards along the sleeve surface from its bottom side as the sleeve 3 rotates in the clockwise direction. The thickness of the layer of the developer on the sleeve surface is controlled by a doctor blade 6 at the lower left-hand side of the magnet 2 such that the developer in a layer with an appropriate thickness will touch the surface of a photosensitive drum 7 where electrostatic latent images have been formed. A density detection sensor 8 for measuring the magnetic permeability of the developer and hence its density is disposed above the magnet 2 such that the density of the developer can be measured as it is carried on the sleeve surface in the clockwise direction. The result of measuremnent by the sensor 8 is relied upon to control the rotation of a supply roller 10 forming a part of a hopper 9 for the toner to be supplied in such a way that the developer density inside the tank 1 will remain constant.

With a density detecting device of FIG. 4, however, the amount of developer which comes into contact with the surface of the sensor is extremely unsteady. In view of the positioning errors involving the doctor 6, the sleeve 3 and the sensor 8, furthermore, it is not possible to guarantee a steady contact condition of the developer on the sensor surface. The assignee herein has thus proposed a new device capable of detecting the developer density relatively stably in spite of the variations in the layer thickness of the developer as it is transported on the sleeve surface and also in spite of errors of limited degrees in positioning the sensor, the sleeve, etc.

The structure of an example of this new device is illustrated in FIG. 5 wherein corresponding components are designated by the same numerals defined above. It is basically different from the device of FIG. 4 in that there is provided a baffle plate 11 at a position downstream with respect to the sensor 8 along the flow of the developer along the sleeve surface. This baffle plate 11 serves to create a small pool 12 of the developer 5 at the position of the sensor 8 as it flows along the sleeve surface. Thus, the amount of the developer dammed up by the baffle plate 11 can be maintained nearly at a constant level even if there are variations in the layer thickness of the developer or errors in the positioning of the sensor or the sleeve, and it is also possible to keep replacing the old developer in the pool by new developer.

As can be seen in FIG. 5, however, there appears an area between the small pool 12 created by the baffle plate 11 and the top surface of the developer stored inside the development tank 1 where the amount of the developer on the sleeve surface decreases suddenly, and it has been observed that such an area causes the movement of the developer to be extremely unsteady inside the pool 12 and that the sensor output changes as the layer thickness of the developer varies on the sleeve surface. In order to solve this problem, experiments were carried out by placing the end of the baffle plate 11 close to the sleeve surface so that a sufficiently stable pool will be formed in the neighborhood of the sensor surface even if the layer thickness of the developer changes but it was found extremely difficult to adjust the gap between the baffle plate 11 and the sleeve surface. Moreover, there is the danger of damaging the sleeve surface if the baffle plate 11 happens to touch it by some mistake.

It is therefore an object of the present invention in view of the above to solve the aforementioned problem by improving the position of the baffle plate to provide a developer density detection device which can create a pool near its sensor surface such that the amount of developer in the pool will not change abruptly.

The above and other objects of the present invention are achieved by placing the baffle plate in such a way that its lower edge is sunk below the surface of the developer stored in the developer tank. This prevents the developer slipping between the baffle plate and the sleeve surface from quickly falling into the tank 1 such that the moition of the developer inside the pool created by the baffle plate will be stabilized.

The accompanying drawings, which are incorporated in and form a part of the specification, illustrate an embodiment of the present invention and, together with the description, serve to explain the principles of the invention.

Figure 1:
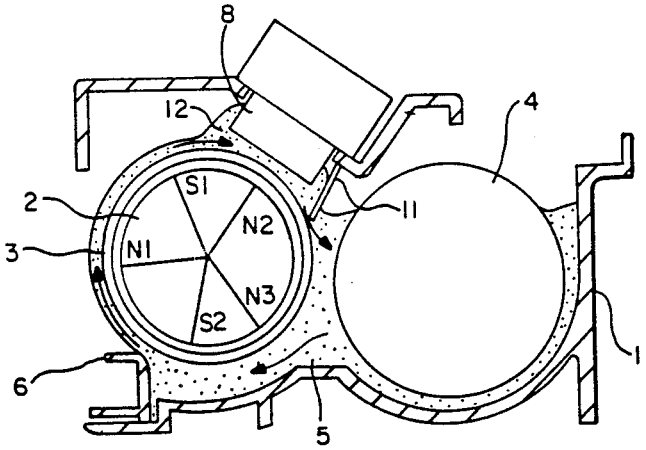
FIG. 1 is a drawing which shows the structure of a development device with a developer density detection device embodying the present invention.
Figure 5:
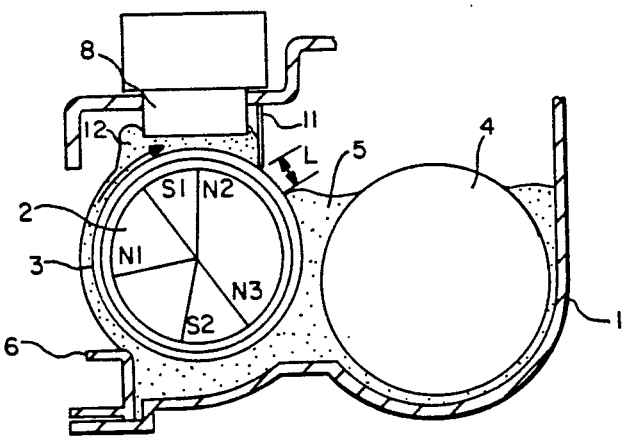
FIG. 5 is a drawing showing the structure of another development device exclusive of the toner container developed by the present inventors during the course of completing the present invention.

The structure of a development device embodying the present invention is shown in FIG. 1 wherein corresponding components are indicated by the same numerals defined above. The development device of FIG. 1 is different from that of FIG. 5 firstly in that the end section of the baffle plate 11 is sunk below the surfaceof the developer in the tank 1, secondly in that the baffle plate 11 and the sensor 8 are rotated around the axis of the magnet 2 in the direction of the flow of the developer and thirdly in that the density detection center of the sensor 8 is made to approximately coincide with a pole center of the magnet 2. The magnet 2 has a principal pole N1 and auxiliary poles N2, N3, S1 and S2. The density detection center of the sensor 8 coincides with the pole center of the auxiliary pole N2 as shown in FIG. 1.

Figure 4:
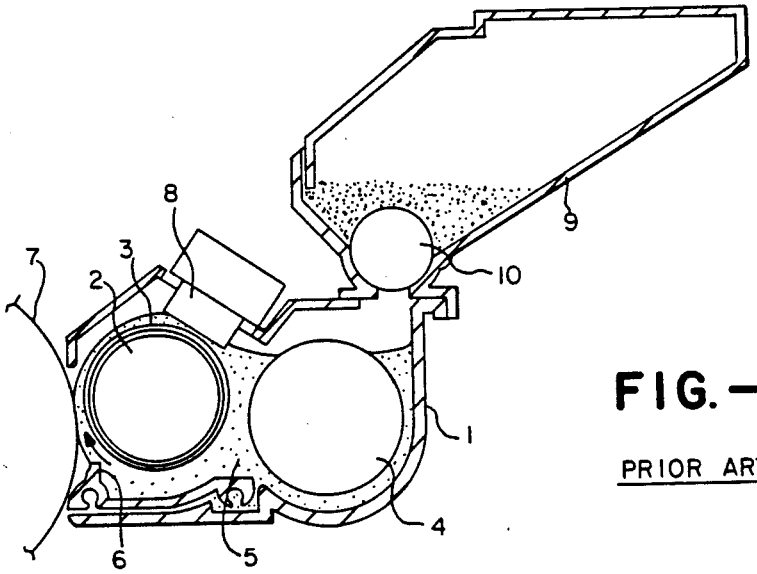
FIG.—4 PRIOR ART
FIG. 4 is a drawing showing the structure of a development device disclosed in Japanese Patent Publication Tokkai 61-57968 published Mar. 25, 1986.

As explained in connection with FIG. 4, the developer inside the developing tank 1 is transported on the sleeve surface in the clockwise direction as the sleeve 3 rotates while the developer is stirred by the stirrer roller 4. The developer being transported on the sleeve surface is dammed up by the baffle plate 11 and forms a small pool 12 near the sensor 8. The developer flows out of this small pool 12 through a gap between the bottom end sectionof the baffle plate 11 and the sleeve surface and travels back into the developing tank 1. The sensor 8 measures the developer density where the pool 12 is formed and controllingly drives a supply roller (not shown in FIG. 1) to supply an appropriate amount of the toner from a supply hopper (not shown in FIG. 1) into the tank 1 so as to maintain the developer density at a specified level.

During the cycle of operations described above, the developer moves around the sleeve 3 as shown by the arrows in FIG. 1. Unlike the mode of motion depicted in FIG. 5, the developer movement near the entrance to the small pool 12 is similar to that near the bottom end section of the baffle plate 11. (It goes without saying that the total flow rate per unit time is the same at these two points). Thus, a desired amount of the developer can always be found in the pool 12 near the sensor 8 in spite of errors which may be committed in positioning the doctor blade 6, the sleeve 3 and he sensor 8 and the detection of density can be performed accurately.

Figure 2:
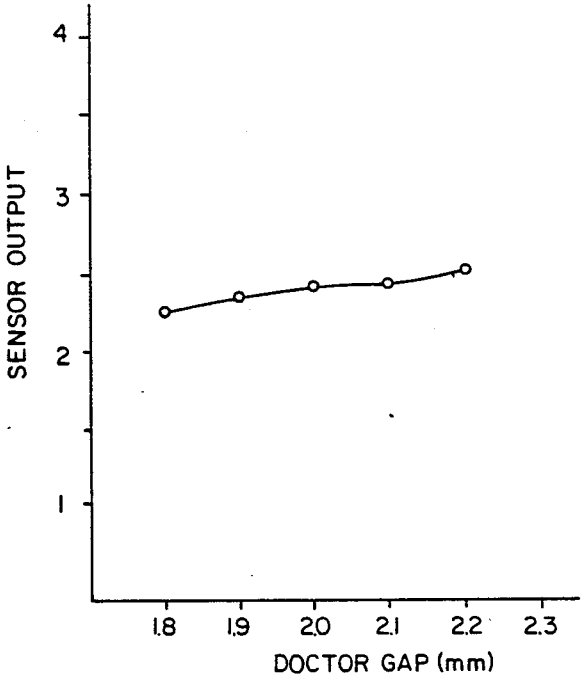
FIG. 2 is a graph which shows the relationship between the doctor gap and the sensor output of the development device of FIG. 1.
Figure 3:
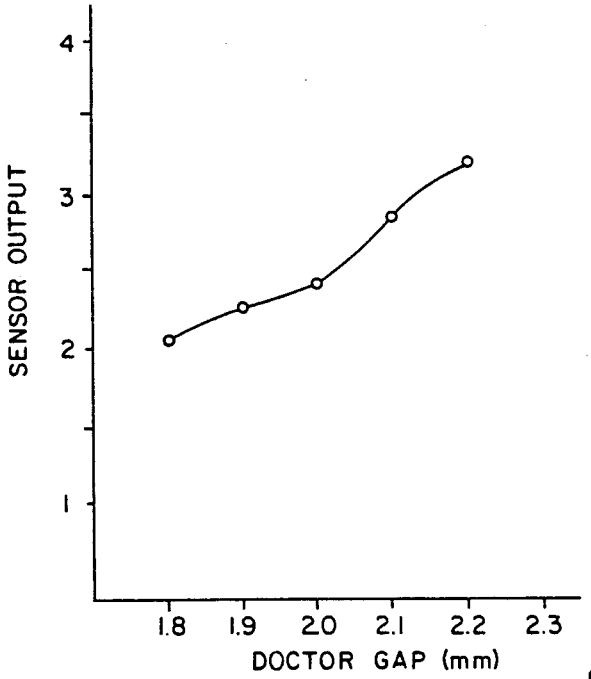
FIG. 3 is a graph which shows the relationship between the doctor gap and the sensor output of a conventional development device.

Additional experiments have shown that the density detection can be effected under a most stable condition if the sensor 8 and the baffle plate 11 are disposed, as shown in FIG. 1 in a somewhat rotated position around an axis which is parallel to the axis of symmetry of the cylindrical magnet 2 in the direction of the flow of the developer and further if the density detection center of the sensor 8 and the pole center of the auxiliary pole N2 are made to approximately coincide with each other. FIG. 2 shows the relationship between the doctor gap (defined herein as the interval between the bottom end of the doctor and the sleeve surface) and the sensor output when the gap between the bottom end part of the baffle plate 11 and the sleeve surface in the structure of FIG. 1 is 1.0 mm. FIG. 2 is intended to show that the sensor output is hardly affected by the variations in the doctor gap caused by errors in positioning the doctor and the sleeve. FIG. 3 shows, for the purpose of comparison, the relationship between the same variables for the priorart device shown in FIG. 5. It is seen that changes in the doctor gap affects the sensor output significantly.

In summary, a stable pool of developer can be formed in the vicinity of the sensor according to the present invention such that the developer will move smoothly without, for example, falling down suddenly to leave the immediate neighborhood of the sensor. For this reason, small errors in positoning the doctor and the sensor do not prevent accurate determination of the developer density. Moreover, since there is no longer the need to place the bottom end of the baffle plate extremely close to the sleeve surface, the separation therebetween can be made sufficiently large so that it can be adjusted easily without the fear of damaging the sleeve surface inadvertently.

The foregoing description of a preferred embodiment of the invention has been presented for purposes of illustration and description. It is not intended to be exhaustive or to limit the invention to the precise form disclosed, and obviously many modifications and variations are possible in light of the above teaching. Such modifications and variations which may be apparent to a person skilled in the art are intended to be included within the scope of the present invention.

What is claimed is:

1. A developer density detection device comprising
a developing tank for holding a developer therein,
a cylindrical magnet,
a sleeve which covers said magnet circumferentially and serves by rotating to transport said developer upward on its outer surface,
a density detection sensor disposed at an elevated position with respect to said magnet and proximately opposite said sleeve so as to be capable of measuring the density of said developer on said sleeve, and
a baffle plate for controlling the flow of said developer, said baffle plate being disposed downstream with respect to said sensor along the direction of flow of said developer, said baffle plate having a bottom end part disposed below the surface level of said developer in said developing tank.

2. The device of claim 1 wherein said density detection sensor is disposed at a rotated position around the axis of said cylindrical magnet in the direction of flow of said developer.

3. The device of claim 1 wherein the density detection center of said density detection sensor approximately coincides with a pole center of said magnet.

4. The device of claim 2 wherein the density detection center of said density detection sensor approximately coincides with a pole center of said magnet.

5. The device of claim 1 further comprising a supply hopper for storing a toner and a supply rate control roller for controlling the supplyof said toner from said hopper into said developing tank.

6. The device of claim 1 further comprising a doctor for controlling the thickness of the layer of said developer flowing on the surface of said sleeve.

7. The device of claim 1 wherein said density detection sensor serves to measure the magnetic permeability of said developer.

8. A developer density detection device comprising
a developing tank for holding a developer therein,
a cylindrical magnet,
a sleeve which covers said magnet circumferentially and serves by rotating to transport said developer upward on its outer surface,
a density detection sensor for measuring the density of said developer, said sensor being disposed at an elevated position with respect to said magnet and the density detection center of said density detection sensor coinciding approximately with a pole center of said magnet, and a baffle plate for controlling the flow of said developer, said baffle plate being disposed downstream with respect to said sensor along the direction of flow of said developer, said baffle plate having a bottom end part disposed below the surface level of said developer in said developing tank.

9. The device of claim 8 wherein said density detection sensor is disposed at a rotated position around the axis of said cylindrical magnet in the direction of flow of said developer.

10. The device of claim 8 further comprising a supply hopper for storing toner and a supply rate control roller for controlling the supply of said toner from said hopper into said developing tank.

11. The device of claim 8 further comprising a doctor for controlling the thickness of the layer of said developer flowing on the surface of said sleeve.

12. The device of claim 8 wherein said density detection sensor serves to measure the magnetic permeability of said developer.

* * * * *